US011702878B2

(12) United States Patent
Terenzi

(10) Patent No.: US 11,702,878 B2
(45) Date of Patent: Jul. 18, 2023

(54) DAMPED AND COMPACT HINGE DEVICE

(71) Applicant: C.M.I. CERNIERE MECCANICHE INDUSTRIALI S.R.L., Valsamoggia (IT)

(72) Inventor: Emanuele Terenzi, Rieti (IT)

(73) Assignee: C.M.I. Cerniere Meccaniche Industriali S.R.L.

( * ) Notice: Subject to any disclaimer, the term of this patent is extended or adjusted under 35 U.S.C. 154(b) by 128 days.

(21) Appl. No.: 17/277,411

(22) PCT Filed: Sep. 18, 2019

(86) PCT No.: PCT/EP2019/075074
§ 371 (c)(1),
(2) Date: Mar. 18, 2021

(87) PCT Pub. No.: WO2020/058366
PCT Pub. Date: Mar. 26, 2020

(65) Prior Publication Data

US 2022/0034140 A1 Feb. 3, 2022

(30) Foreign Application Priority Data

Sep. 20, 2018 (IT) ..... 102018000008772

(51) Int. Cl.
*E05F 1/12* (2006.01)

(52) U.S. Cl.
CPC ..... *E05F 1/1276* (2013.01); *E05Y 2201/21* (2013.01); *E05Y 2201/26* (2013.01); *E05Y 2900/30* (2013.01)

(58) Field of Classification Search
CPC ..... F24C 15/023; E05F 1/1276; E05F 1/1261; E05Y 2201/21; E05Y 2201/26; E05Y 2900/30; E05Y 2900/308
See application file for complete search history.

(56) References Cited

U.S. PATENT DOCUMENTS 7,610,656 B2 * 11/2009 Vanini ..... E05F 1/1261 16/286
8,533,914 B2 * 9/2013 Vanini ..... F24C 15/023 16/50

(Continued)

FOREIGN PATENT DOCUMENTS

EP 1 183 988 A2 3/2002
WO 2018/109130 A1 6/2018

OTHER PUBLICATIONS

The International Search Report (ISR) and the Written Opinion (WO) of the International Searching Authority (ISA/EPO), International Application No. PCT/EP2019/075074 filed Sep. 18, 2019, ISR/WO dated Nov. 18, 2019, 12 pages in total.

*Primary Examiner* — Victor D Batson
*Assistant Examiner* — Matthew J Sullivan
(74) *Attorney, Agent, or Firm* — Ware, Fressola, Maguire & Barber LLP

(57) ABSTRACT

The damped and compact hinge device includes a spring (17) fixed to a first member (3) and a second end coupled to interconnection means (13) having a first mobile pin (27) of a lever (23) sliding along a first slot (29) of the first member (3). The interconnection means (13) further includes a rod (31) connecting the lever (23) to a first end of a rocker arm (35), the rocker arm (35) having a first end linked via the rod (31) to the first mobile pin (27) and having an opposite end rotatably connected to a second member (5) by a fixing pin (37) spaced from a pivot pin (7). A median portion of the rocker arm (35) has a second mobile pin (41) for sliding in a second slot (43) of the first member (3), the second slot (43) being rectilinear, curved, or S or C shaped.

18 Claims, 6 Drawing Sheets

(56) References Cited

U.S. PATENT DOCUMENTS

| | | | | |
|---|---|---|---|---|
| 8,677,565 | B2 * | 3/2014 | Vanini | E05D 3/06 16/286 |
| 8,985,717 | B2 * | 3/2015 | Marzorati | E05F 1/1261 49/386 |
| 9,157,262 | B2 * | 10/2015 | Lee | E05D 3/12 |
| 9,995,075 | B2 * | 6/2018 | Vanini | E05F 1/1246 |
| 10,145,157 | B2 * | 12/2018 | White | E05F 5/06 |
| 10,451,291 | B2 * | 10/2019 | White | E05F 5/02 |
| 10,494,851 | B2 * | 12/2019 | Dora | E05D 15/40 |
| 10,551,070 | B2 * | 2/2020 | Park | E05B 53/00 |
| 10,794,102 | B2 * | 10/2020 | Vanini | E05F 1/12 |
| 11,136,798 | B2 * | 10/2021 | Park | E05F 1/1261 |
| 11,187,021 | B2 * | 11/2021 | Gherardi | E05F 1/1261 |
| 11,268,313 | B2 * | 3/2022 | Terenzi | E05D 3/14 |
| 11,384,578 | B2 * | 7/2022 | Lee | E05C 17/20 |
| 11,441,344 | B2 * | 9/2022 | White | E05F 1/1261 |
| 2003/0213098 | A1 | 11/2003 | Cummins et al. | |
| 2021/0025214 | A1 * | 1/2021 | Dora | E05F 15/622 |

* cited by examiner

DAMPED AND COMPACT HINGE DEVICE

BACKGROUND

The present invention relates to the technical field concerning hinges for household appliances, furnishings and the like and refers to a balanced, damped and compact hinge device suitable for doors with vertical and horizontal rotation axis and also in appliances and furnishings that provide little space for the hinges.

There are known hinges provided with weight balancing springs and springs acting on shoes or rollers fixed to the fixed hinge member to elastically press them against profile cams formed in the edge of a movable hinge member where these cams are profiled with metastable housing recesses of the rollers in certain intermediate or end positions of the rotation of the movable members of the hinges.

A disadvantage of these known hinges consists in the fact that they are bulky and unsuitable for certain uses, for example they are not suitable for domestic or artisan ovens because of their dimensions.

Another disadvantage of said known hinges consists in the fact that they are complex and therefore expensive and subject to malfunctions or breakdowns.

Prior documents EP 1 183 988 A2, US 2003/213098 A1, and WO 2018/109130 A1 disclose a hinge device for closing and opening a respective door and comprising a first element fixed to a body of an apparatus and a second element fixed to the door of said apparatus. Said hinge device comprises a friction shoe for damping the rotation of the second element thereof.

DISCLOSURE OF THE INVENTION

An object of the present invention is to propose a compact hinge device which is very compact, balanced and damped, suitable also for installations with limited space for housing the hinge device, such as for example domestic ovens.

Another object is to propose a hinge device suitable for various furnishing devices and applications.

A further object is to propose an alternative hinge to those known.

BRIEF DESCRIPTION OF THE DRAWINGS

The characteristics of the invention are below highlighted with particular reference to the accompanying drawings in which.

DETAILED DESCRIPTION

Figure 1:
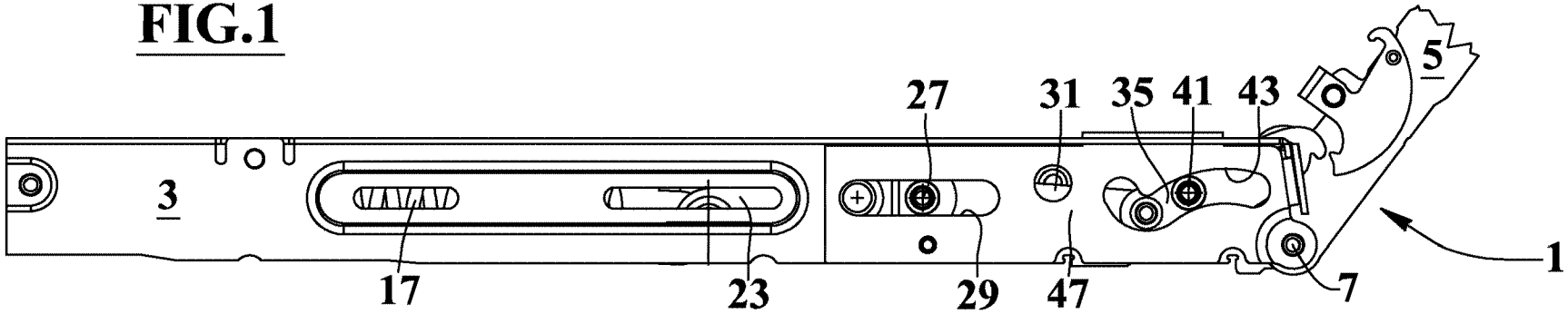
FIG. 1 shows a side view of the damped and compact hinge device of the present invention in a partially open condition and in which some parts have been removed to better highlight others.
Figure 2:
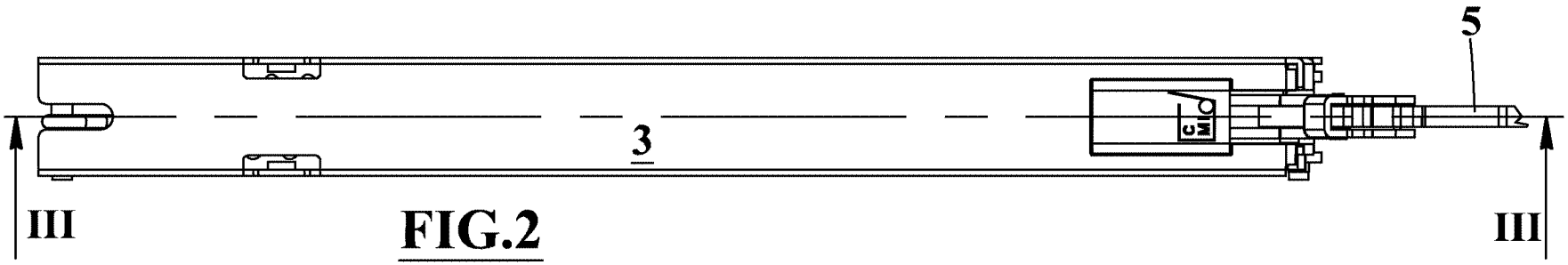
FIG. 2 shows a partial top view of the device of FIG. 1.
Figure 3:
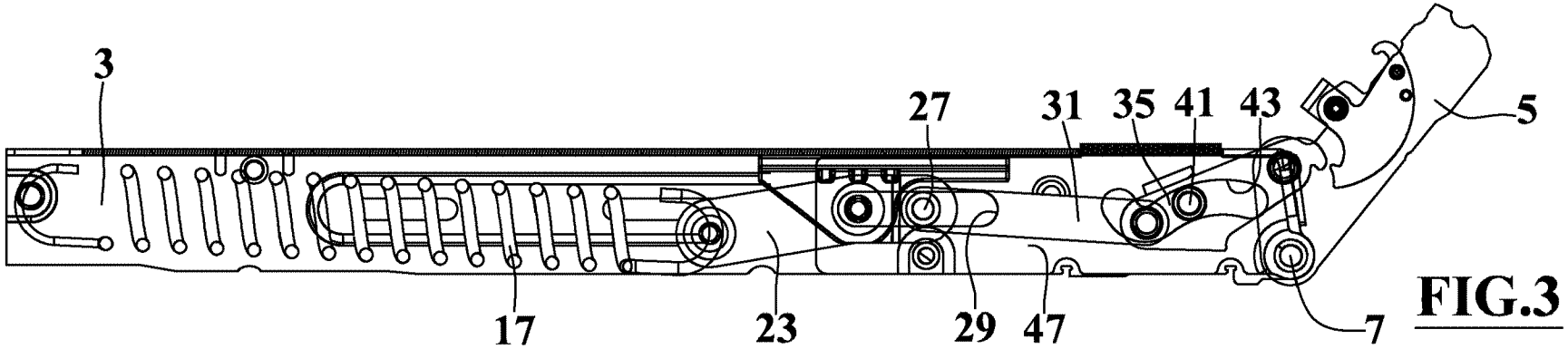
FIG. 3 shows a section view according to the plane III-III of FIG. 2.

With reference to FIGS. 1-10, numeral 1 indicates the damped and compact hinge device of the present invention for flaps, leafs, hatches and apparatus doors, such as for example ovens and other household appliances, and furniture for closing and opening of a respective door. In the following we will use the terms apparatus and door to indicate all the possible different applications of the device.

In an operating condition of assembly with the apparatus, the device 1 comprises a first member 3 fixed to a body or frame of the apparatus and a second member 5 fixed to the door of said apparatus or made in said door where said first member 3 and second member 5 are mutually connected by a pivot pin 7 for the rotation of the door around the geometric axis of rotation of said pivot pin 7 between end opening A (see FIG. 6) and closing C (see FIG. 4) conditions. The pivot pin 7 is fixed in respective ends of the first member 3 and the second member 5.

The device 1 comprises a friction shoe means 9 made of alloy, for example die-cast zamak, or of die-cut and folded sheet metal, a face of which, preferably flat and provided with a friction element or a layer of friction material, slides on a preferably flat surface of a respective friction wall means 11 of the first member 3 which is preferably made of die-cut or cut and folded metal sheet, having an elongated shape similar to a "C" profile.

The friction shoe means 9 is connected to the second member 5 by means of interconnection means 13 which cause the sliding of the friction shoe means 9 along the friction wall means 11 following the rotation of the member 5 for door opening and closure.

This device 1 comprises a linear resilient means 17 having a first end fixed to a connection 19 locked to the end of the first member 3 opposite to the pivot pin 7. The resilient means 17 preferably comprises a helical spring operating in extension or a helical spring operating in compression and equipped with a spring guide but may be constituted by any other mechanical device equivalent to a spring.

The second end of the resilient means 17 is connected to a first fixing pin 21 of a first end of a lever means 23 for transmitting to this latter an elastic force away from the second member 5.

The lever means is preferably of the type with two facing side walls, parallel, spaced apart and equal to each other joined by a cross-sectional wall or bridge made in a single body of cut and folded sheet; in this way the lever means 23 can accommodate, between its side walls, the ends of the elements to which it is connected, improving the transmission of the forces and reducing friction and wear.

A portion of this lever means 23 between its ends has a swivelling connection means 25 which is connected to the friction shoe means 9 and its second end, opposite to the one having the first fixing pin 21, is equipped with a first mobile pin 27 sliding along first slot means 29 of the first member 3 or of an element fixed thereto 3. These first slot means 29 are preferably straight and parallel to the friction wall means 11 but alternatively they can be inclined with respect to this friction wall means 11 and can be straight or curved.

In the preferred embodiment, the swivelling connection means 25 of the lever means 23 is located at a distance from the first mobile pin 27 which is between half and one fifth of the distance between the swivelling connection means 25 and the first fixing pin 21. The two portions of the lever means 23 separated by the swivelling connection means 25 are almost rectilinear and reciprocally angled to form, between them, an angle of about 170° to 120°. Consequently the lever means 23 is slightly curved or bent. Therefore the geometrical axes of the first fixing pin 21, of the swivelling connection means 25 and of the first mobile pin 27 are preferably placed at the vertices of an obtuse geometric triangle.

The connection 19 of the first member 3 for the corresponding end of the resilient means 17 is placed on the same side of the geometric plane defined by the friction wall means 11 of the first fixing pin 21 and of the friction shoe means 9 and the distance of said connection 19 from this plane is less than the distance of the first fixing pin 21 from the same geometric plane. In this way the resilient means 17 is inclined with respect to said plane and transmits to the lever mean 23 an elastic force with a component directed towards said geometric plane by pressing the friction shoe means 9 against the friction wall means 11. The remaining part of the elastic force of the resilient means 17 is transmitted to the second member 5 balancing the door weight if the device is mounted with a horizontal rotation axis.

To regulate the pressure that the friction shoe means 9 exerts onto the friction wall means 11 and therefore to regulate the friction and the braking effect of the device, in addition to properly choosing the geometric and physical parameters of the resilient means 17, it is possible to adjust the lengths and the inclinations of the arms of the lever means 23 separated from the swivelling connection means 25 or to adjust the position, inclination and/or shape of the first slot means 29.

Figure 4:
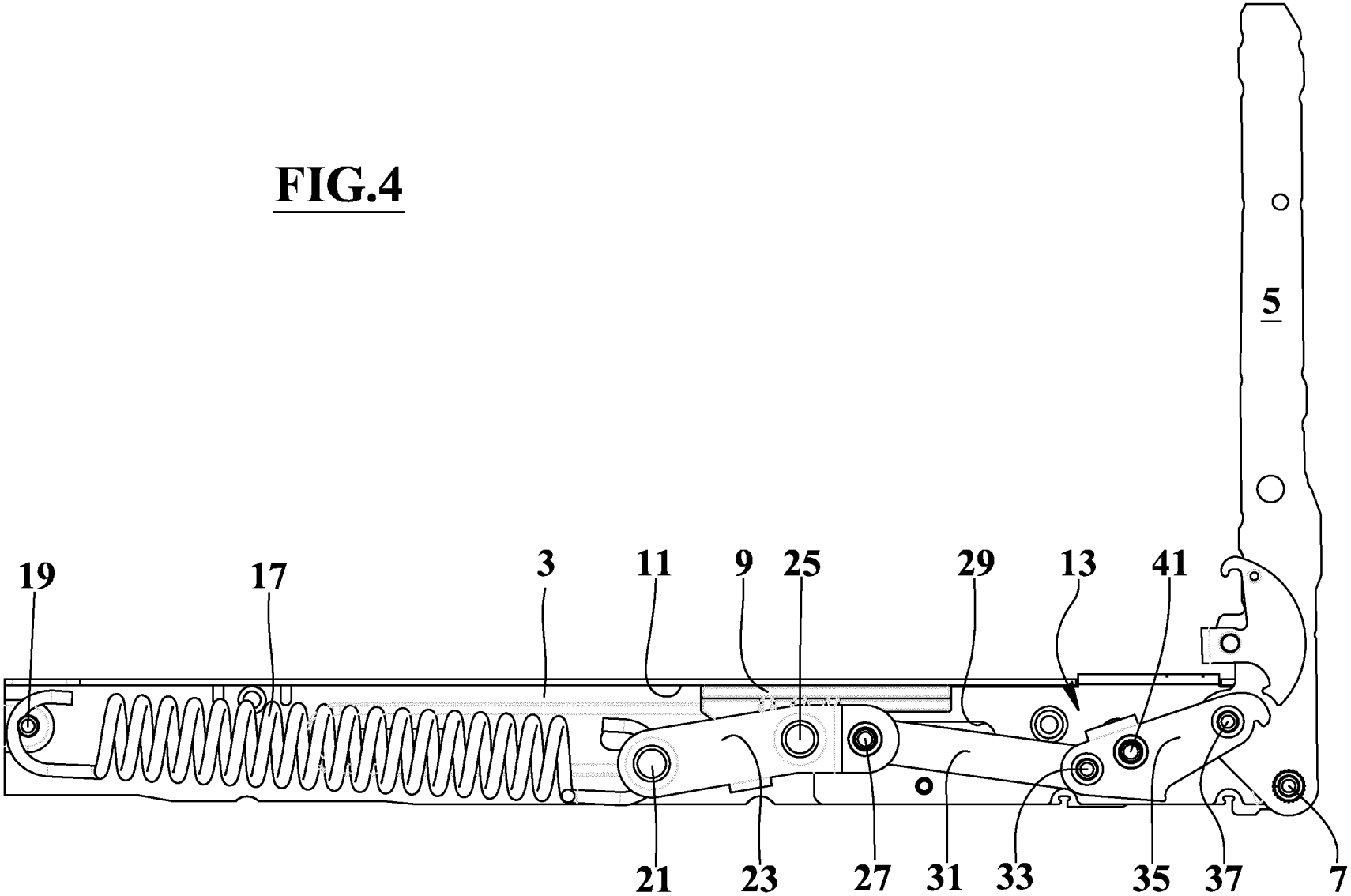
FIG. 4 shows a view of the device of FIG. 1 in a closed condition and in which some parts have been removed to better highlight others.
Figure 5:
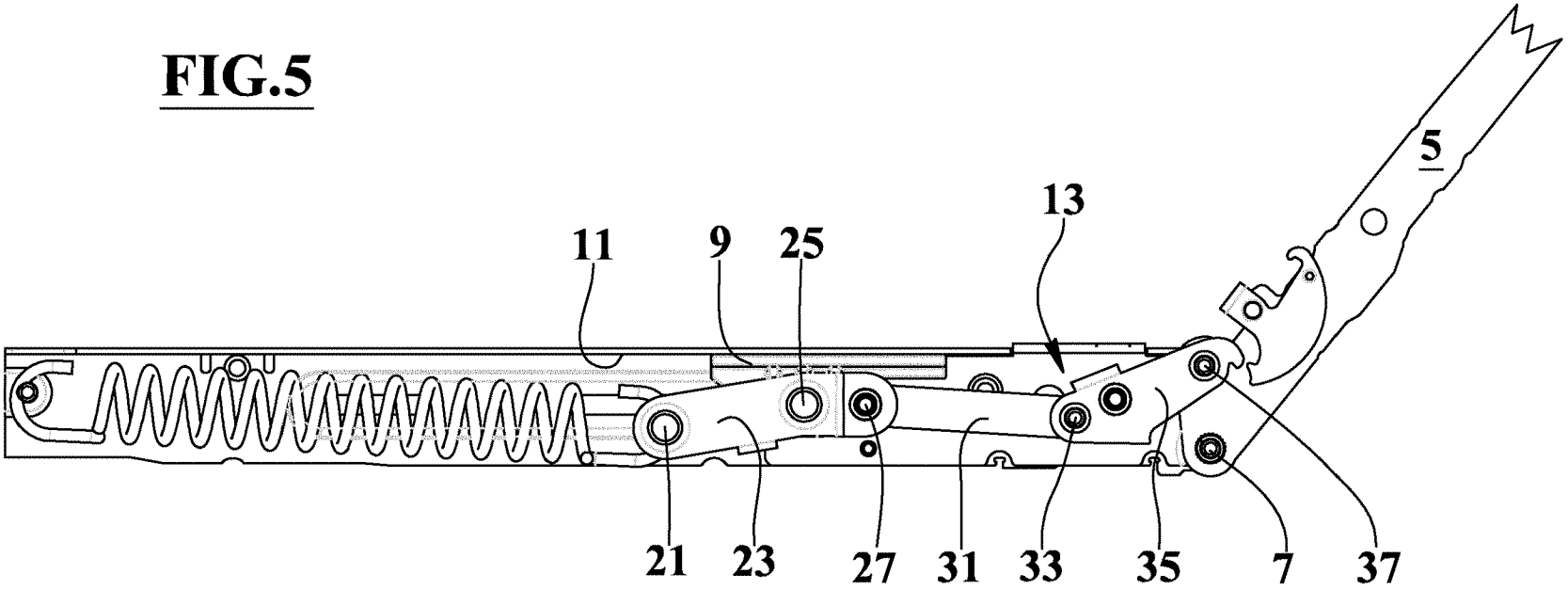
FIGS. 5 and 6 show the device of FIG. 4 respectively in partial and total opened conditions.

Alternatively, in contrast to that shown in FIG. 4, the connection 19 of the first member 3 for the corresponding end of the resilient means 17 can be placed on the other side of the geometric plane defined by the friction wall means 11, i.e., above the plane of the top wall of the first member 3 opposite to the sliding surface provided for the friction shoe means 9, thereby obtaining a more marked inclination of the resilient means 17 with the corresponding end thereof extending out to the alternative connection 19 through an opening (not shown) in the top wall of the first member 3.

The interconnection means 13 comprise a rod means 31, for example consisting of an elongated metal or alloy parallelepiped element, having one end rotatably connected to the first mobile pin 27 and the opposite end rotatably connected by a second fixing pin 33 at a first end of a rocker arm means 35 whose opposite end is rotatably connected to the second member 5 by means of a third fixing pin 37 spaced from the pivot pin 7.

The interconnection means 13 therefore comprise the transmission chain consisting of the arm of the lever means 23 comprised between the swivelling connection means 25 and the first mobile pin 27, the rod means 31 and the rocker arm means 35.

The middle portion of the rocker arm means 35 carries a second mobile pin 41 slidable in second slot means 43 of the first member 3 or of an element fixed thereto 3. The second slot means 43 are straight or preferably curved shaped as "S", "C" or similar.

In particular, said second slot means 43 are shaped so as to vary the angle of the rod means 31 and of the rocker arm means 35 with respect to the geometric plane defined by the friction wall means 11 as a function of the opening angle of the second member 5 and door; in this way it is possible to vary the door balancing force according to the opening angle.

Figure 6:
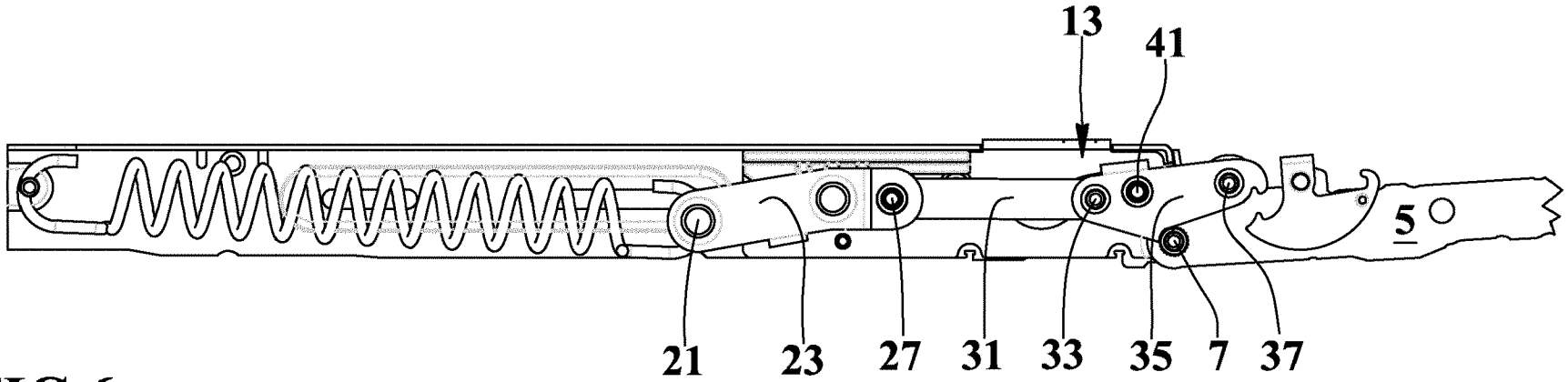
Figure 7:
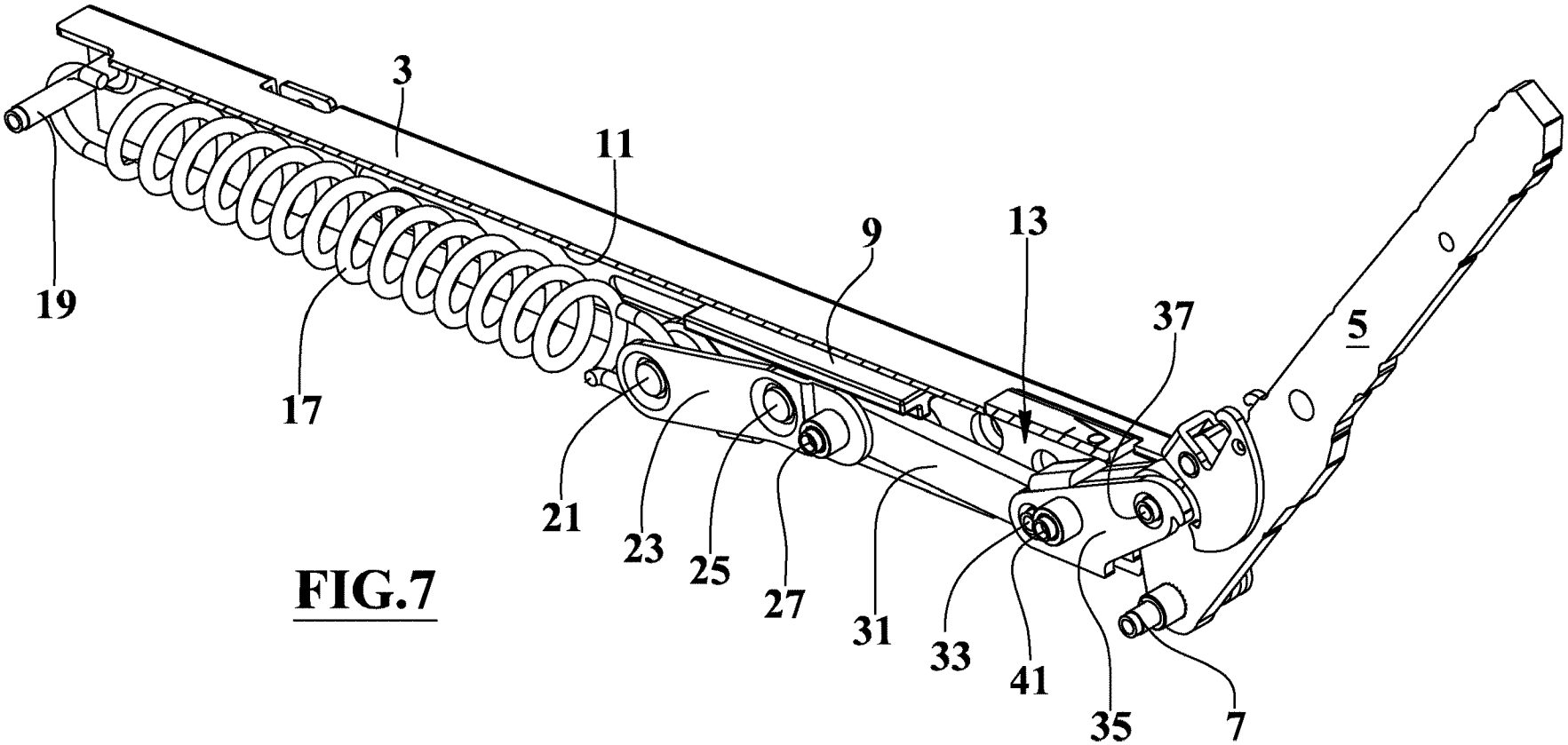
FIG. 7 shows an axonometric view of the device of FIG. 4 in a condition of partial opening.
Figure 8:
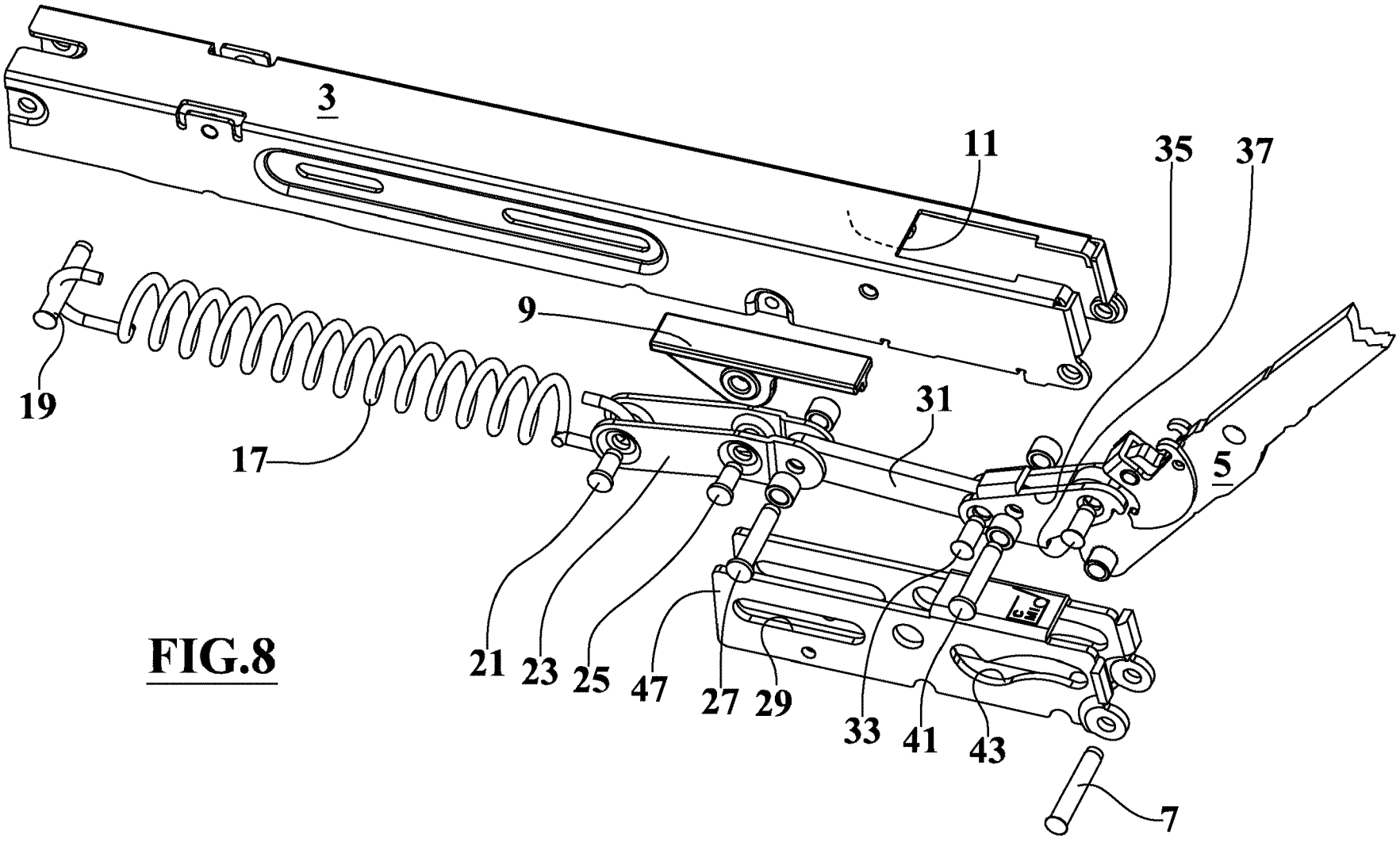
FIG. 8 shows an axonometric and exploded view of the damped and compact hinge device object of the present invention.
Figure 10:
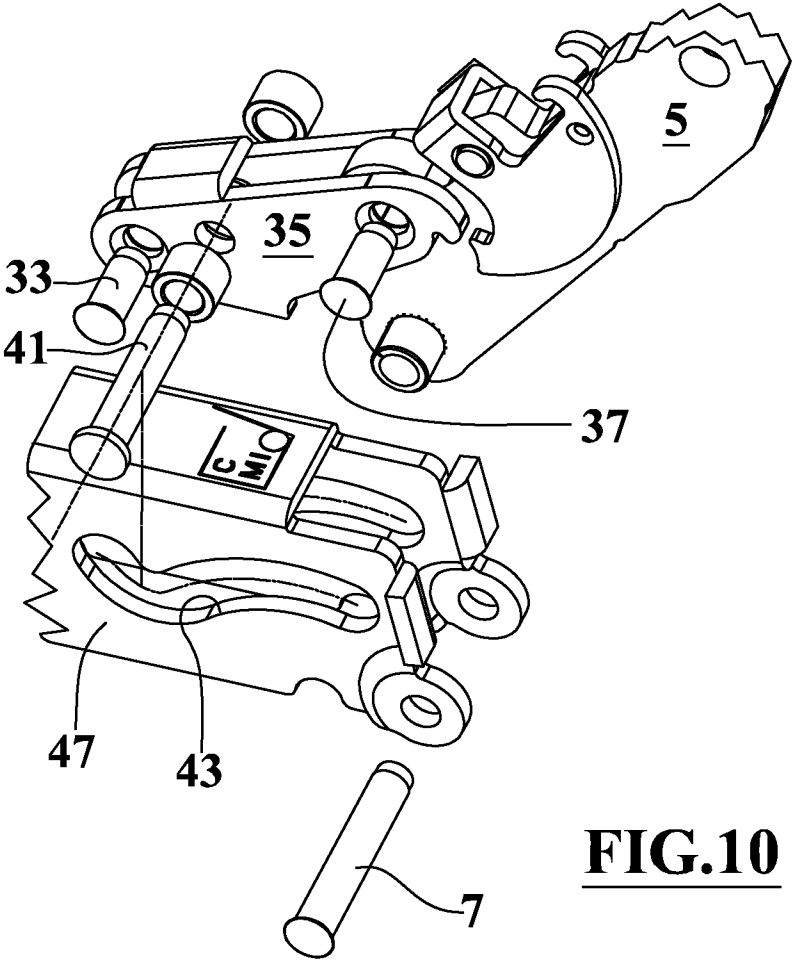
FIGS. 9 and 10 show respective enlarged details of FIG. 8.
Figure 9:
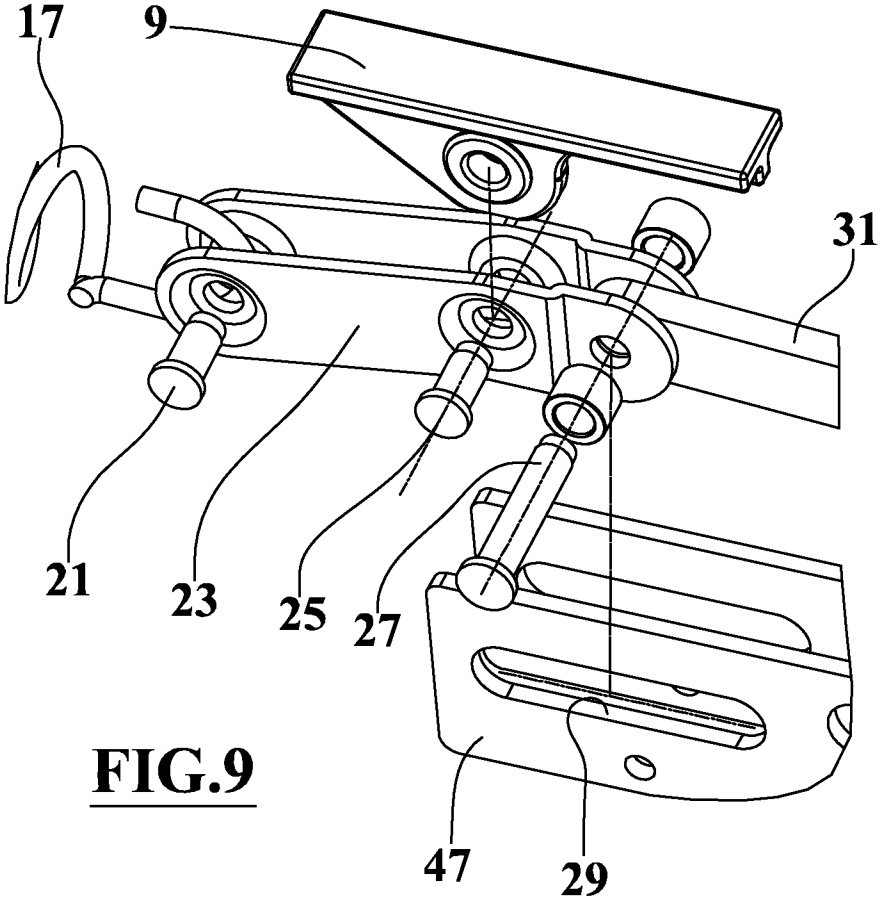

Preferably the second slot means 43 are shaped so that the rod means 31, in the end open condition, is almost parallel to the geometrical plane defined by the friction wall means 11, as shown in FIG. 6, and that, in the closed condition, has the maximum angle with respect to said plane, as shown in FIG. 4.

The connection 19, the first fixing pin 21, the swivelling connection means 25, the first mobile pin 27, the second fixing pin 33, the third fixing pin 37 and the second mobile pin 41 are parallel to the pivot pin 7.

Each of the first slot means 29 and second slot means 43 comprises two identical facing and spaced-apart slots formed in two side walls, facing, opposite and parallel, of a guide element 47 made of cut and stamped and folded sheet metal, fixed in the portion of the first member 3 adjacent to the pivot pin 7 or integrated therewith.

These slots of each of the first 29 and second slot means 43 house the ends of the first mobile pin 27 and of the second mobile pin 41, respectively. The ends of the first mobile pin 27 and second mobile pin 41 can be equipped with bushes or rolling means for a fluid and better movement along the couples of the first slot means 29 and the second slot means 41, respectively.

The rocker arm means 35 is preferably of the type with two parallel side walls, facing each other, spaced apart and equal, mutually joined by a transversal wall or bridge made in a single body of cut and bent sheet metal and the rocker arm means 35 is triangular or rectangular and the geometrical axes of the second fixing pin 33, of the third fixing pin 37 and of the second mobile pin 41 are almost coplanar.

The invention claimed is:

1. Damped and compact hinge device for doors, shutters and hatches of an apparatus or furnishing for closing and opening a respective door and comprising, in an operating condition of assembly to the apparatus, a first member (3) fixed to a body of the apparatus and a second member (5) fixed to the door of the apparatus or made in the door, wherein the first member (3) and the second (5) member are mutually connected by a pivot pin (7) for the rotation of the door around a rotation geometric axis of said pivot pin (7) between extreme opening (A) and closing (C) conditions of the door; the device (1) further comprising a friction shoe (9) sliding on a respective friction wall means (11) of the first member (3) and connected to the second member (5) by means of interconnection means (13) causing the sliding of the friction shoe (9) along the friction wall means (11) following the rotation of the second member (5) for opening and closing the door; the device further comprising a linear resilient means (17) having a first end fixed to a connection (19) of the first member (3) and a second end connected to a first fixing pin (21) borne by a first end of a lever means (23) of the device for transmitting to the lever means (23) an elastic force away from the second member (5), wherein the lever means (23) is connected to the friction shoe (9) by means of a swiveling connection means (25); wherein the connection (19) of the first member (3) for the corresponding end of the resilient means (17) is placed on a side of a geometrical plane defined by the friction wall means (11) opposite to that of the friction shoe (9) or is placed on a same side of the geometrical plane defined by the friction wall means (11) of the first fixing pin (21) and of the friction shoe (9) and a distance of said connection (19) from this plane is lower than a distance of the first fixing pin (21) from the geometric plane so as to incline the resilient means (17) with respect to the geometric plane and to transmit to the lever means (23) an elastic force with a direct component towards the geometrical plane by pressing the friction shoe (9) against the frictional wall means (11); wherein a second end of the lever means (23), opposite to the first end bearing the first fixing pin (21), is provided with a first mobile pin (27) for sliding along first slot means (29) of the first member (3) or of an element fixed to the first member (3), the first slot means (29) oriented parallel or inclined with respect to the friction wall means (11); wherein the interconnection means (13) comprise a rocker arm means (35) having a first end linked to the first mobile pin (27) and having an opposite end rotatably connected to the second member (5) by a third fixing pin (37) spaced from the pivot pin (7); wherein a median portion of the rocker arm means (35) has a second mobile pin (41) for sliding in a second slot means (43) of the first member (3) or of an element fixed to the first member (3), the second slot means (43) having a rectilinear shape, a curved shape, or an S or C shape.

2. The device according to claim 1, wherein a linkage between the first end of the rocker arm means (35) and the first mobile pin (27) is carried out by means of a rod means (31) of the interconnection means (13), the rod means (31) having an end rotatably connected to the first mobile pin (27) and an opposite end of the rod (31) rotatably connected by means of a second fixing pin (33) to the first end of the rocker arm means (35) opposite to the third fixing pin (37).

3. The device according to claim 2, wherein the second slot means (43) are shaped so as to vary an angle of the rod means (31) and of the rocker arm means (35) with respect to the geometric plane defined by the friction wall means (11) according to an opening angle of the second member (5) and door.

4. The device according to claim 3, wherein the second slot means (43) are shaped so that the rod means (31), in an extreme opening condition, is almost parallel to the geometric plane defined by the friction wall means (11) and in a closed condition, has a maximum angle with respect to said plane.

5. The device according to claim 1, wherein the connection (19), the first fixing pin (21), the swiveling connection means (25), the first mobile pin (27), the second fixing pin (33), the third fixing pin (37) and the second mobile pin (41) are parallel to the pivot pin (7).

6. The device according to claim 1, wherein the first member (3) is made of cut and printed metal plate and has an approximately elongated shape with a "C" section.

7. The device according to claim 6, wherein each of the first slot means (29) and the second slot means (43) comprises two equal slots obtained in two facing, opposite and parallel walls of a guide element (47) made of cut and printed and folded metal plate, fixed in a portion of the first member (3) adjacent to the pivot pin (7) where the slots of each of the first slot means (29) and the second slot means (43) houses opposite ends, respectively, of the first mobile pin (27) and of the second mobile pin (41).

8. The device according to claim 1, wherein the lever means (23) is curved or bent and the geometrical axes of the first fixing pin (21), of the swiveling connection means (25) and of the first mobile pin (27) are placed at the vertices of an obtuse geometric triangle and that the rocker arm means (35) is triangular or rectangular and geometrical axes of the second fixing pin (33), of the third fixing pin (37) and of the second mobile pin (41) are almost coplanar.

9. The device according to claim 1, wherein the resilient means (17) comprises a helical spring operating in extension.

10. Damped and compact hinge device for closing and opening a door of an apparatus, the hinge device comprising, in an operating condition of assembly to the apparatus, a first member (3) fixed to a body of the apparatus; and a second member (5) fixed to the door of the apparatus or made in the door, wherein the first member (3) and the second (5) member are mutually connected by a pivot pin (7) for the rotation of the door around a rotation geometric axis of said pivot pin (7) between extreme opening (A) and closing (C) conditions of the door; the hinge device (1) further comprising:

a friction shoe (9) for sliding on a respective friction wall (11) of the first member (3) and connected to the second member (5) by means of an interconnection device (13) causing the sliding of the friction shoe (9) along the friction wall (11) following a rotation of the second member (5) for opening and closing the door;

a linear resilient means (17) having a first end fixed to a connection (19) of the first member (3) and a second end connected to a first fixing pin (21) of a first end of a lever means (23) for transmitting to the lever means (23) an elastic force away from the second member (5), said lever means (23) connected to the friction shoe (9) by means of a swiveling connection means (25); wherein the connection (19) of the first member (3) for the corresponding first end of the resilient means (17) is placed on the friction wall (11) or at a first distance from the friction (11) wall, a second distance of the first fixing pin (21) from the friction wall is greater than the first distance so that the resilient means (17) is inclined with respect to the friction wall an elastic force is transmitted to the lever means (23) having a direct component towards the friction wall for pressing the friction shoe (9) against the frictional wall (11); wherein the first member (3) and the second (5) member are mutually connected by a pivot pin (7) for the rotation of the door around a rotation geometric axis of said pivot pin (7) between extreme opening (A) and closing (C) conditions of the door; wherein a second end of the lever means (23), opposite the first end bearing the first fixing pin (21), is provided with a first mobile pin (27) sliding along a first slot (29) of the first member (3) or of an element fixed to the first member (3), the first slot (29) aligned parallel or inclined with respect to the friction wall (11); the interconnection device (13) further comprising a rocker arm (35) having a first end linked to the first mobile pin (27) and having an opposite end rotatably connected to the second member (5) by a third fixing pin (37) spaced from the pivot pin (7); wherein a median portion of the rocker arm (35) has a second mobile pin (41) for sliding in a second slot (43) of the first member (3) or of an element fixed to the first member (3), the second slot (43) having a rectilinear or curved shape, or an S or C shape.

11. The device according to claim 10, wherein a linkage between the first end of the rocker arm (35) and the first mobile pin (27) is carried out by means of a rod (31) of the interconnection device(13), the rod(31) having an end rotatably connected to the first mobile pin (27) and an opposite end rotatably connected, by a second fixing pin (33) to the first end of the rocker arm (35) opposite to the third fixing pin (37).

12. The device according to claim 11, wherein the second slot (43) is shaped so as to vary an angle of the rod (31) and of the rocker arm (35) with respect to a sliding surface of the friction wall (11) according to an opening angle of the second member (5) and door.

13. The device according to claim 12, wherein the second slot (43) is shaped so that the rod (31), in the extreme opening condition, is almost parallel to the sliding surface defined by the friction wall means (11) and in the closed condition has a maximum angle with respect to the sliding surface.

14. The device according to claim 10, wherein the connection (19), the first fixing pin (21), the swiveling connection means (25), the first mobile pin (27), the second fixing pin (33), the third fixing pin (37) and the second mobile pin (41) are parallel to the pivot pin (7).

15. The device according to claim 10, wherein the first member (3) is made of cut and printed metal plate and has an approximately elongated shape with a "C" section.

16. The device according to claim 15, wherein each of the first slot (29) and the second slot (43) comprises two equal slots obtained in two facing, opposite and parallel walls of a guide element (47) made of cut and printed and folded metal plate, fixed in a portion of the first member (3) adjacent to the pivot pin (7) where said slots of each of the first slot (29) and the second slot (43) houses respective opposite ends of the first mobile pin (27) and of the second mobile pin (41).

17. The device according to claim 10, wherein the lever (23) is curved or bent and geometrical axes of the first fixing pin (21), of the swiveling connection means (25) and of the first mobile pin (27) are placed at vertices of an obtuse geometric triangle and that the rocker arm (35) is triangular or rectangular and geometrical axes of the second fixing pin (33), of the third fixing pin (37) and of the second mobile pin (41) are almost coplanar.

18. The device according to claim 10, wherein the resilient means (17) comprises a helical spring operating in extension.

* * * * *